US009266651B2

(12) United States Patent
Lanier

(10) Patent No.: US 9,266,651 B2
(45) Date of Patent: Feb. 23, 2016

(54) SEALING DEVICE FOR A CONTAINER

(75) Inventor: Romain Lanier, Veury-Voroize (FR)

(73) Assignee: Becton Dickinson France, Le Pont-de-Claix (FR)

( * ) Notice: Subject to any disclaimer, the term of this patent is extended or adjusted under 35 U.S.C. 154(b) by 0 days.

(21) Appl. No.: 14/110,835

(22) PCT Filed: Apr. 10, 2012

(86) PCT No.: PCT/EP2012/001546

§ 371 (c)(1),
(2), (4) Date: Oct. 9, 2013

(87) PCT Pub. No.: WO2012/139746

PCT Pub. Date: Oct. 18, 2012

(65) Prior Publication Data

US 2014/0034646 A1 Feb. 6, 2014

(30) Foreign Application Priority Data

Apr. 14, 2011 (EP) ..... 11305436

(51) Int. Cl.

*B65D 45/32* (2006.01)
*B65D 51/00* (2006.01)
*B65D 51/18* (2006.01)

(52) U.S. Cl.

CPC ..... *B65D 51/002* (2013.01); *B65D 2255/20* (2013.01)

(58) Field of Classification Search

CPC ... B65D 51/002; B65D 1/002; B65D 2255/20
USPC ..... 220/361, 319, 320; 215/273, 272, 274, 215/277

See application file for complete search history.

(56) References Cited

U.S. PATENT DOCUMENTS

| | | | | |
|---|---|---|---|---|
| 5,143,237 | A * | 9/1992 | Lindsey et al. | 215/330 |
| 6,047,840 | A * | 4/2000 | Moore et al. | 215/330 |
| 6,095,358 | A * | 8/2000 | Marino | 215/330 |
| 7,401,706 | B2 * | 7/2008 | Shingle | 215/220 |
| 7,451,899 | B2 * | 11/2008 | de Pous | 222/321.9 |
| 8,777,031 | B2 * | 7/2014 | Aneas | 215/249 |
| 2001/0037990 | A1 * | 11/2001 | Pous et al. | 215/272 |
| 2011/0000872 | A1 | 1/2011 | Aneas | |
| 2012/0160850 | A1 * | 6/2012 | Gelibert et al. | 220/320 |

FOREIGN PATENT DOCUMENTS

FR 2927316 A1 8/2009

* cited by examiner

*Primary Examiner* — Mickey Yu
*Assistant Examiner* — Niki Eloshway
(74) *Attorney, Agent, or Firm* — The Webb Law Firm

(57) ABSTRACT

The present invention relates to a sealing device for a container having an opening and an outer projection, including: a septum for closing said opening, a cap having a retainer capable of switching from a first position, in which the retainer does not limit the axial movement of said cap with respect to said container, to a second position, in which the retainer limits the axial movement of the cap, and a sleeve receiving said cap and movable axially with respect to said cap between a distal position, in which said sleeve does not exert a radial inward force on said retainer, and a proximal position, in which said sleeve exerts a radial inward force on said retainer. The sleeve includes a guiding element capable of cooperating directly or indirectly with said outer projection, so as to limit rotation of said sleeve.

18 Claims, 9 Drawing Sheets

SEALING DEVICE FOR A CONTAINER

BACKGROUND OF THE INVENTION

1. Field of the Invention

The present invention relates to a sealing device for a prefillable container and to an assembly comprising such a sealing device and container in order to obtain a secure prefillable container to be filled with a medicine, for use for example in combination with an infusion pump in treatments where a controlled delivery of a medicine to a patient is needed.

2. Description of Related Art

Infusion pumps devices and systems are well known in the medical art, for use in delivering or dispensing a prescribed medicine such as insulin to a patient. For example, such devices may comprise a compact pump housing adapted to receive a container prefilled with a prescribed medicine for automated administration to a patient through infusion tubing and an associated catheter. The infusion pump is often designed to be extremely compact and may thus be adapted to be carried by the patient, for example, by means of a belt clip. The medicine may then be administered in an automated manner, without significant restriction on the patient's mobility or life-style. In addition, the patient may manage his own treatment by replacing himself an empty container by a new prefilled container in the system he is carrying.

In such a case, it is very important that the prefilled container the patient is provided with be securely sealed until it is needed for use by the patient. In particular, the sealing device of the container may not be removable. Moreover, the sealing device or the sealing step of the container before use must not be at the origin of a contamination of the medicine contained in the container. In addition, the prefilled container must be able to be secured and locked in place in the infusion pump system by the patient in a simple while reliable manner. Indeed, inadvertent displacement of the prefilled container in the infusion pump system, before or during delivery of the medicine, may result in inadequate administration of the prescribed medicine and constitute a danger for the patient. In particular, it would be desirable that the sealing device does not move with respect to the collar of the container, neither axially nor rotationally, during the delivery step of the medicine.

Sealing devices of containers exist which use an aluminum foil which is crimped over the collar of the container. Nevertheless, such sealing devices are not satisfying because the crimping of the aluminum foil over the collar may generate particles capable of contaminating the medicine present in the container.

Moreover, the filling of the empty containers and their sealing usually take place within the premises of the pharmaceutical companies producing the prescribed medicine. These companies must fill in and seal millions of containers and these steps usually take place on assembly lines and are as much as possible completed by automated machines: these steps are therefore reproducible and reliable.

Anyway, the automated sealing of a container filled with a medicine implies that the sealing device may be installed on the collar of a container regardless of the orientation of the sealing device with respect to the collar at the time the sealing step starts, i.e. at the time the sealing device is approached to the collar by a machine.

An aspect of the present invention is to provide a sealing device for a container allowing an optimized sealing step of the container once filled.

An aspect of the invention is a sealing device for a container having a proximal end and a distal end, said distal end being provided with a collar defining an opening aligned on an axis A and provided with an outer flange, said container being provided on its outer wall with at least one outer projection, the sealing device comprising:

a septum sealingly engageable with said opening when said sealing device is mounted on said container, a cap receiving said septum and capable of receiving at least part of said collar when said sealing device is mounted on said container, said cap comprising retaining means capable of switching from a first position, in which they do not limit the axial movement of said cap with respect to said collar when said sealing device is mounted on said container, to a second position, in which they limit said axial movement under the action of a radial inward force exerted thereon, a sleeve receiving said cap and movable axially with respect to said cap between a distal position, in which said sleeve does not exert a radial inward force on said retaining means, and a proximal position, in which said sleeve exerts radial inward force on said retaining means, wherein said sleeve further comprises guiding means capable of cooperating directly or indirectly with said at least one outer projection of said container, so as to limit the rotation of said sleeve with respect to said container when said sleeve is in its proximal position, regardless from the orientation with which the sealing device is mounted on said container.

SUMMARY OF THE INVENTION

In this application, the distal end of a component or of a device must be understood as meaning the end furthest from the hand of the user and the proximal end must be understood as meaning the end closest to the hand of the user. In particular, in the present application, the container being for example intended to be used as a prefilled cartridge for an infusion pump, the distal end must be understood as meaning the end closest to the top of the container (i.e. the end of the container provided with the opening to be sealed with a septum) and the proximal end must be understood as being the end closest to the bottom of the container.

Another aspect of the invention is an assembly comprising a container having a proximal end and a distal end, said distal end being provided with a collar defining an opening aligned on an axis A and provided with an outer flange, said container being provided on its outer wall with at least one outer projection, and a sealing device intended to be mounted on said container so as to seal its opening, said sealing device comprising:

a septum sealingly engageable with said opening when said sealing device is mounted on said container, a cap receiving said septum and capable of receiving at least part of said collar when said sealing device is mounted on said container, said cap comprising retaining means capable of switching from a first position, in which they do not limit the axial movement of said cap with respect to said collar when said sealing device is mounted on said collar, to a second position, in which they limit said axial movement under the action of a radial inward force exerted thereon, a sleeve receiving said cap and movable axially with respect to said cap between a distal position, in which said sleeve does not exert a radial inward force on said retaining means, and a proximal position, in which said sleeve exerts radial inward force on said retaining means, wherein said sleeve further comprises guiding means capable of cooperating directly or indirectly with said at least one outer projection of said container, so as to limit the rotation of said sleeve with respect to said container when said sleeve is in its proximal position, regardless from the orientation with which the sealing device is mounted on said container.

"Cooperating directly" means in the present application that the guiding means cooperates with the outer projection by entering directly in contact with said outer projection, in other words without the assistance of an intermediate element or piece of the device. "Cooperating indirectly" means in the present application that the guiding means cooperates with the outer projection by the intermediary of an intermediate piece, part or element of the device, said intermediate piece, part or element transferring the effect it is submitted to from the guiding means to the outer projection, said guiding means not entering in direct contact with said outer projection.

The container of the present invention may be of a tubular shape: in use, the proximal end of the container may be closed for example by a transversal wall of the container or by a stopper provided at the proximal end of a tube forming the wall of the container. In embodiments, the proximal end of the container is closed by a stopper. The container may be made of any material capable of storing a medicine, such as glass material or plastic material.

The sealing device of the invention may be mounted on the container, in particular on the distal end of the container, without having to follow a specific orientation of said sealing device with respect to the container. The sealing device enables the sleeve to be totally immobilized with respect to the container once the container is sealed. This is particularly advantageous for containers filled with a prescribed medicine and which are provided to the patients prefilled and sealed with a sealing device of the invention. The patient may then simply install such sealed prefilled container for example in an infusion pump system and command the delivery of the medicine with no fear of displacement of the sleeve of the sealing device and therefore no fear that the container be incorrectly positioned in the infusion pump system and that an incorrect dose of medicine be administered. Furthermore, with such sealed prefilled container, the patient is sure that the container is contamination free, even if it has already been used before.

In the assembly of the invention, the sealing device is secured axially and rotationally with respect to the container and its collar.

In embodiments, said guiding means comprise a plurality of radial teeth distributed along the inner wall of said sleeve. For example, the radial teeth may be regularly distributed along a circumference of the inner wall of the sleeve. The regular distribution of the teeth ensures that the sealing device may be mounted on the container without any specific orientation of the said sealing device with respect to said container.

In embodiments, a space defined between two adjacent radial teeth is dimensioned so as to receive in engagement at least part of said outer projection when said sealing device is mounted on said container and said sleeve is in its proximal position, said guiding means and outer projection therefore cooperating directly with each other so as to limit rotation of said sleeve with respect to said container. It is therefore ensured that whatever the orientation with which the sealing device is mounted on the container, the outer projection of the outer wall of the container will be engaged within two radial teeth and the sleeve will be blocked in rotation, clockwise and counterclockwise, with respect to the container.

In embodiments, said plurality of radial teeth is located at a proximal end of said sleeve. For example, then, said outer projection is proximally spaced from a proximal end of the collar. The plurality of radial teeth and the outer projection face each other and cooperate together so as to block the sleeve in rotation with respect to the container, when the sealing device is mounted on the container and the sleeve is in its proximal position. With such an embodiment the outer wall of the collar itself may be left free of any outer projection: this facilitates the checking of the level of medicine filled in the container during the filling step. Such checking step may be automated by means of a light sensor, for example.

In alternative embodiments, said cap is provided on its outer wall with one or more outer radial dots substantially distributed along a circumference of the outer wall of said cap, and on its inner wall with a plurality of inner radial dots distributed along a circumference of the inner wall of said cap, the space defined between two adjacent radial teeth being dimensioned so as to be capable of receiving in engagement one outer radial dot when said sleeve is in its proximal position in order to limit the rotation of said sleeve with respect to said cap, the space defined by two adjacent inner radial dots being dimensioned so as to be capable of receiving in engagement at least part of said outer projection, when said sealing device is mounted on said container and said sleeve is in its proximal position, said guiding means and outer projection therefore cooperating indirectly with each other in order to limit the rotation of said sleeve with respect to said container. For example, the inner radial dots are substantially regularly distributed along a circumference of the inner wall of the cap. In such embodiments, the cap plays the role of an intermediate part transferring the effort it is submitted to, from the guiding means, to the outer projection, the guiding means being not in direct contact with the outer projection of the container.

In embodiments, said retaining means comprise one or more proximal skirt pieces of said cap, each skirt piece being radially flexible and being provided with a radial peg so that, in the first position of the retaining means, said radial pegs are not in abutment on a proximal face of said distal outer flange, and in the second position of said retaining means, said radial pegs are in abutment against the proximal face of said distal outer flange, thereby limiting the axial movement of said cap with respect to said collar.

In its proximal position, the sleeve, by forcing the skirt pieces towards the axis A of the opening, secures permanently said cap and septum with respect to said collar when the sealing device is mounted on said container.

For example, said plurality of inner radial dots is located on the inner walls of said skirt pieces. In such a case, said outer projection may be located on the outer wall of the collar.

In embodiments, said outer projection is selected from one radial dot and a plurality of radial dots distributed regularly or not along a circumference of the outer wall of the container.

BRIEF DESCRIPTION OF THE DRAWINGS

The sealing device and assembly of the invention will now be further described in reference to the following description and attached drawings in which.

DESCRIPTION OF THE INVENTION

Figure 1:
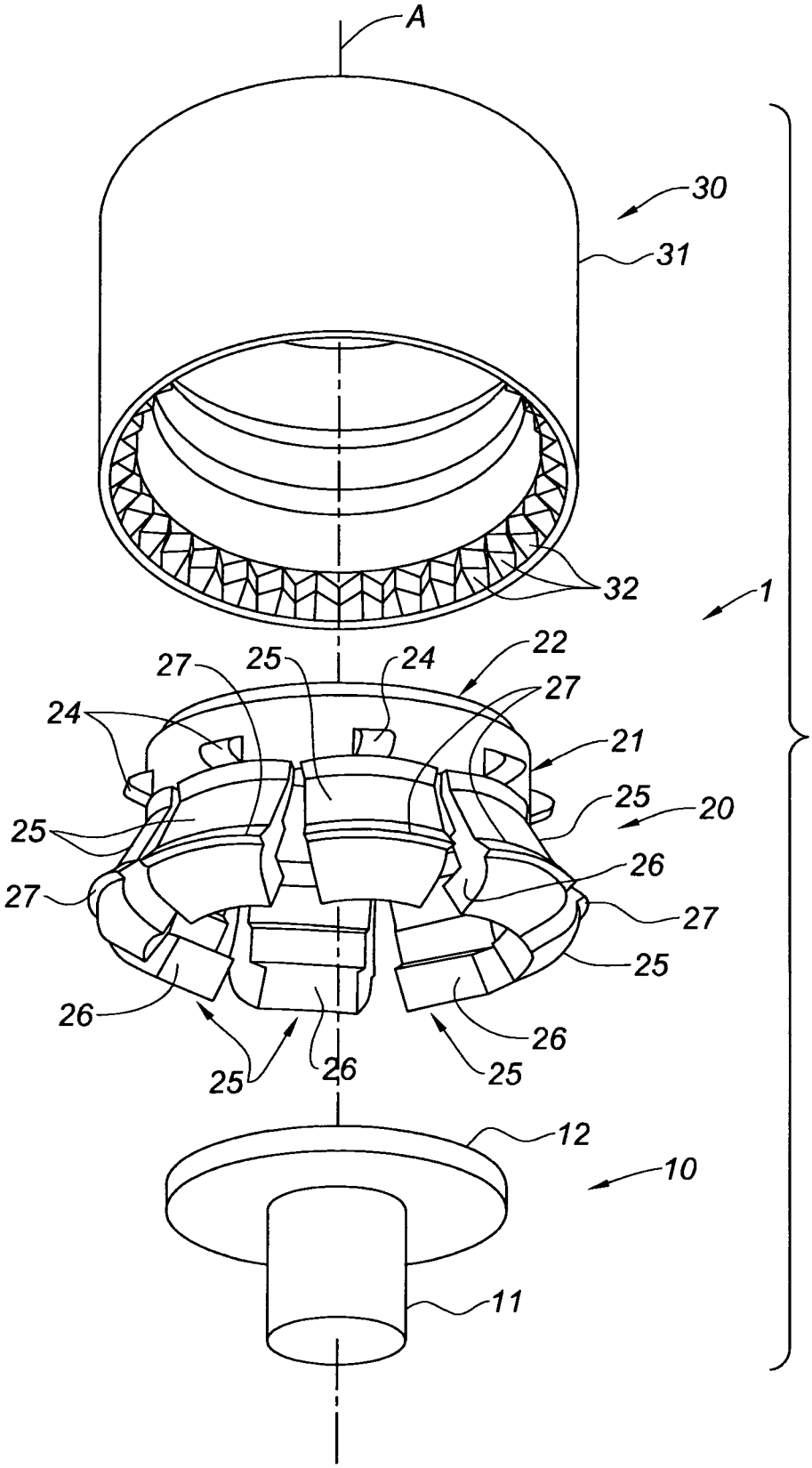
FIG. 1 is an exploded view of a sealing device of the invention.

With reference to FIG. 1 is represented a sealing device 1 of the invention intended to be mounted on a container having at its distal end a collar defining an opening in order to seal said opening, as will be described in details below.

Figure 4:
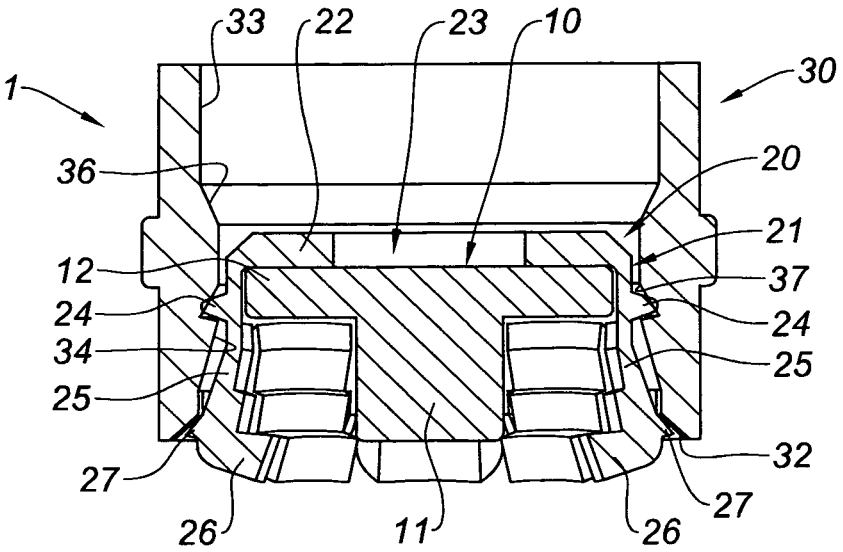
FIG. 4 is a side cross section view of the sealing device of FIG. 1 in the distal position of the sleeve.

With reference to FIGS. 1 and 4, the sealing device 1 comprises a septum 10, a cap 20 receiving the septum 10, and a sleeve 30 receiving the cap 20: all these pieces are aligned on longitudinal axis A of sealing device 1.

As will appear in the description below, the septum 10 is intended to close the opening of the container 40 (see FIGS. 5 and 6) in a tight manner. For instance, the container 40 may be filled with a liquid medicine and the septum 10 is intended to prevent all leaks from the container 40. In this view, the septum 10 is designed and shaped so as to be able to close said opening and it is usually made of a rubber material. In the example shown on FIG. 1, the septum 10 comprises a cylindrical part 11 intended to be received within the collar of the container and a transversal wall 12 intended to bear on a flange of the container 40 (see FIGS. 5 and 6).

Figure 2:
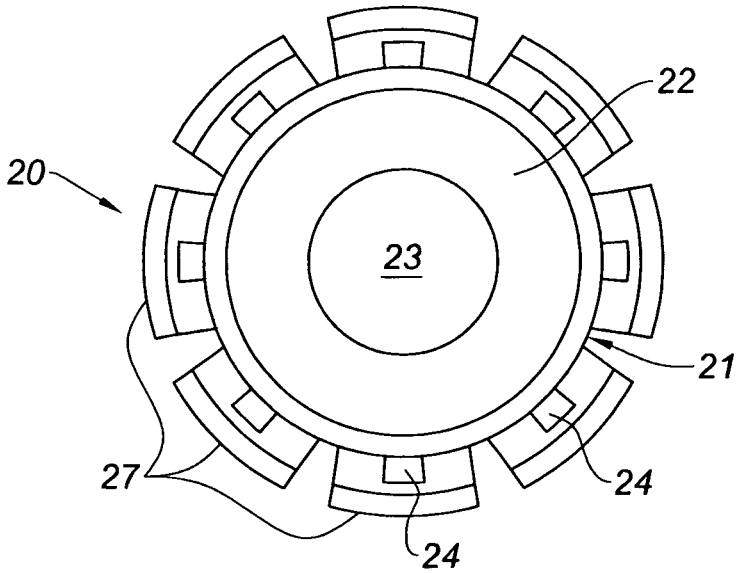
FIG. 2 is a top view of the cap of the sealing device of FIG. 1.

The cap 20 is intended to receive the septum 10 and to receive at least part of the collar of the container. In this view, the cap 20 has the global shape of a ring 21 provided at its distal end with an annular transversal wall 22. With reference to FIG. 2, the annular transversal wall 22 defines a central hole 23: as will appear in the description below, this hole 23 provides an access to the septum 10 when the sealing device 1 is mounted on the container it is intended to seal.

The outer wall of the ring 21 is provided with a plurality of radial projections 24, aligned along a circumference of the ring 21 on the example shown, the function of which will be explained later.

The cap 20 is further provided with a plurality, eight on the example shown, of proximal skirt pieces 25, extending from a proximal end of the ring 21. As appears from FIG. 1, these proximal skirt pieces 25 are identical and they substantially occupy the entire circumference of the cap 20. On FIG. 1, these proximal skirt pieces 25 are in a rest position, in which they extend radially outwardly with respect to axis A of the sealing device 1. In addition, each skirt piece 25 is provided on the inner wall of its free end with a radial peg 26, the function of which will be explained later. Each skirt piece 25 is further provided on the outer wall of its free end with an outer extension 27.

In embodiments not shown, the number of skirts pieces could be different, such as between 4 and 12 for example.

The sleeve 30 is intended to receive the cap 20: the sleeve 30 has globally the shape of a tubular part 31 designed and shape so as to be able to receive the cap 20. As appears from FIGS. 1 and 3, the inner wall of the tubular part 31 is provided with a plurality of radial teeth 32, regularly distributed along a circumference of said inner wall on the example shown. On the example shown on FIGS. 1 and 3, the plurality of radial teeth 32 is provided at the proximal end of the tubular part 31 forming the sleeve 30.

Figure 3:
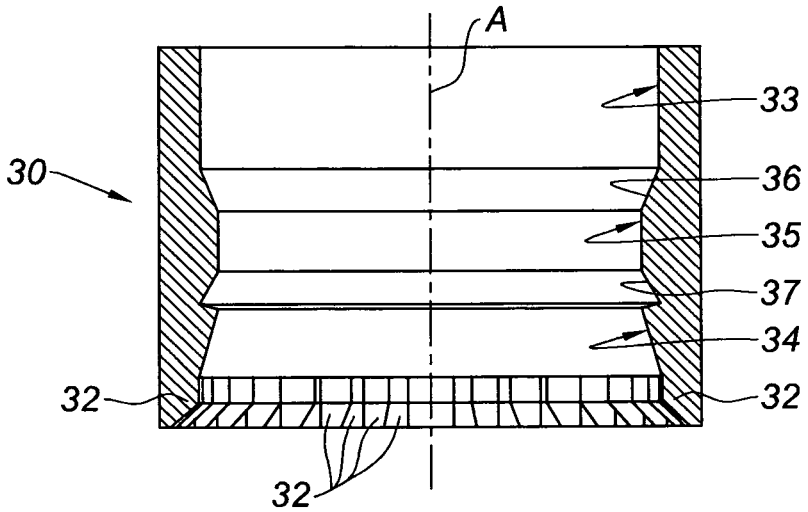
FIG. 3 is a side cross section view of the sleeve of FIG. 1.

With reference to FIG. 3, the tubular part 31 is substantially divided along its longitudinal axis A in three portions having different wall thicknesses: a distal portion 33 which is a tubular portion, a proximal portion 34 which is substantially conical and which bears the plurality of radial teeth 32 at its proximal end, and an intermediate portion 35 located between the distal portion 33 and the proximal portion 34 and which is also a tubular portion. The thickness of the intermediate portion 35 is greater than the one of the distal portion 33 and the respective inner walls of the distal portion 33 and those of the intermediate portion 35 are linked to each other by a slanted wall defining an annular conical wall 36. The proximal portion 34 and the intermediate portion 35 are linked to each other by another slanted wall defining an annular conical groove 37 in the inner wall of the tubular part 31. As such, the annular conical groove 37 is proximally spaced from the annular conical wall 36. Indeed, the annular conical groove 37 is separated from the annular conical wall 36 by the intermediate portion 35.

As will appear from the description below, the sleeve 30 is movable axially with respect to the cap 20 between a distal position, shown on FIG. 4, in which the said radial projections 24 of the ring 21 of the cap 20 are engaged in the annular conical groove 37 of the sleeve 30 and in which the sleeve 30 does not exert a radial inward force on the skirt pieces 25 of the cap 20, and a proximal position, shown on FIG. 6, in which the outer extensions 27 of the skirt pieces 25 of the cap 20 are engaged in the annular conical groove 37 of the sleeve 30 and in which the sleeve 30 via the wall of its intermediate portion 35 exerts radial inward force on the skirt pieces 25 of the cap 20.

The sealing step of a container with the sealing device 1 of FIGS. 1-4 will now be described with reference to FIGS. 4-8.

With reference to FIGS. 5-8, the container 40 to be sealed has a classical tubular shape having a proximal end 40*a* and a distal end 40*b*; the proximal end 40*a* may be closed by a transversal wall or by a stopper (not shown). The container 40 may be made of any material adapted for storing and delivering a medicine, such as a liquid medicine for example. For instance, the container may be made of glass or plastic material. The container 40 is provided at its distal end 40*b* with a collar 41 defining an opening 42 aligned on a longitudinal axis A. In the example shown, the collar 41 and the container 40 are made of one single piece. Alternatively, the collar 41 could be formed from a different element, however fixed on the container. The collar 41 is provided with a distal outer flange 43. On the example shown the container 40 is further provided on its outer wall with an outer projection under the shape of plurality of radial dots 44: as shown on FIGS. 5 and 6, these radial dots 44 are proximally spaced from the proximal end 41*a* of the collar 41. Moreover, as appears from FIG. 7, these radial dots 44 are aligned along a circumference of the container 40 but they do not occupy the entire length of said circumference: for example, on the example shown, they are provided only on half the length of the circumference of the container 40.

In alternative embodiments not shown, the plurality of radial dots could occupy the entire length of the circumference or on the contrary the outer projection could be under the form of only one radial dot.

The sealing device 1 is provided to proceed with the sealing step in the distal position of the sleeve 30 as shown on FIG. 4. As mentioned before, the sealing step is usually completed by machines at pharmaceutical premises once the container 40 has been filled in with the adequate medicine. The open filled in container 40 is therefore usually treated on an assembly line. The sealing device 1 is intended to be seized by a machine and put on the top of the container 40 in view of sealing it.

In its position as shown on FIG. 4, the septum 10 is force fitted in the cap 20 with an access to the septum 10 through the central hole 23 of annular transversal wall 22 of cap 20. The sleeve 30 receives the cap 20 and the septum 10 and is in its distal position with respect to the cap 20, with the radial projections 24 of the ring 21 of the cap 20 engaged in the annular conical groove 37 of the sleeve 30. In this position, the sleeve 30 does not exert a radial inward force on the skirt pieces 25 of the cap 20 which are therefore outwardly radially deflected.

In such a position of the sleeve 30, the whole sealing device 1, i.e. septum 10, cap 20 and sleeve 30, may be seized by a machine grasping the sleeve 30, since the three pieces of the sealing device 1 are coupled to each other as described above.

Figure 5:
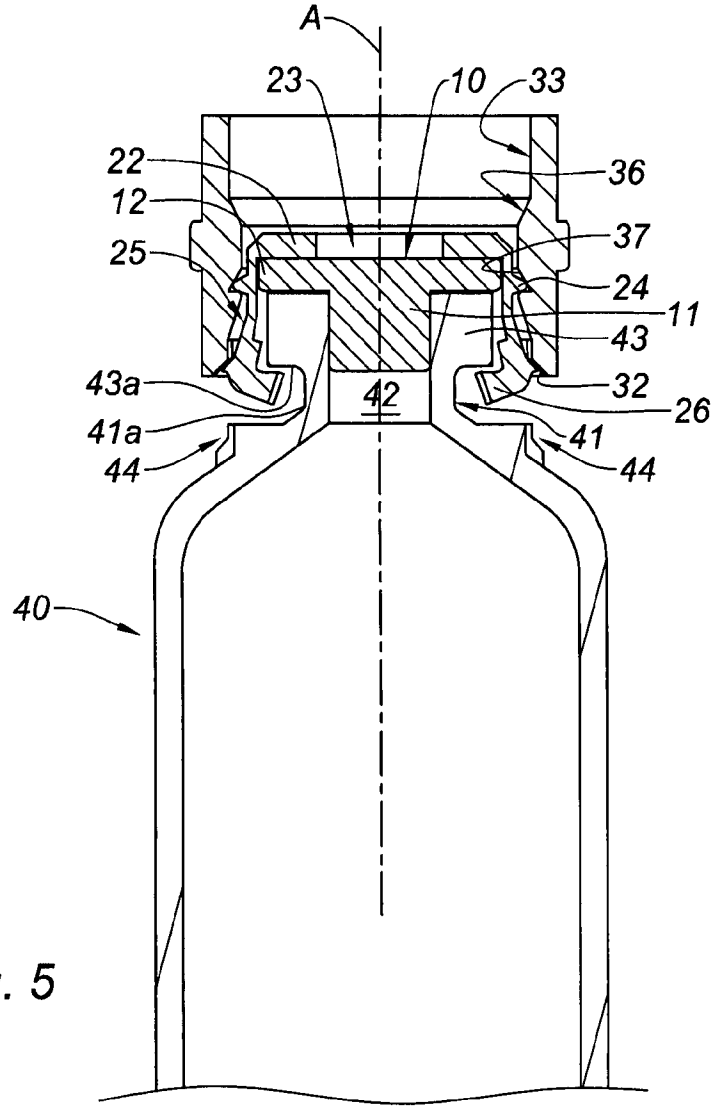
FIG. 5 is a cross section view of the sealing device of FIG. 1 once mounted on a container in the distal position of the sleeve.
Figure 7:
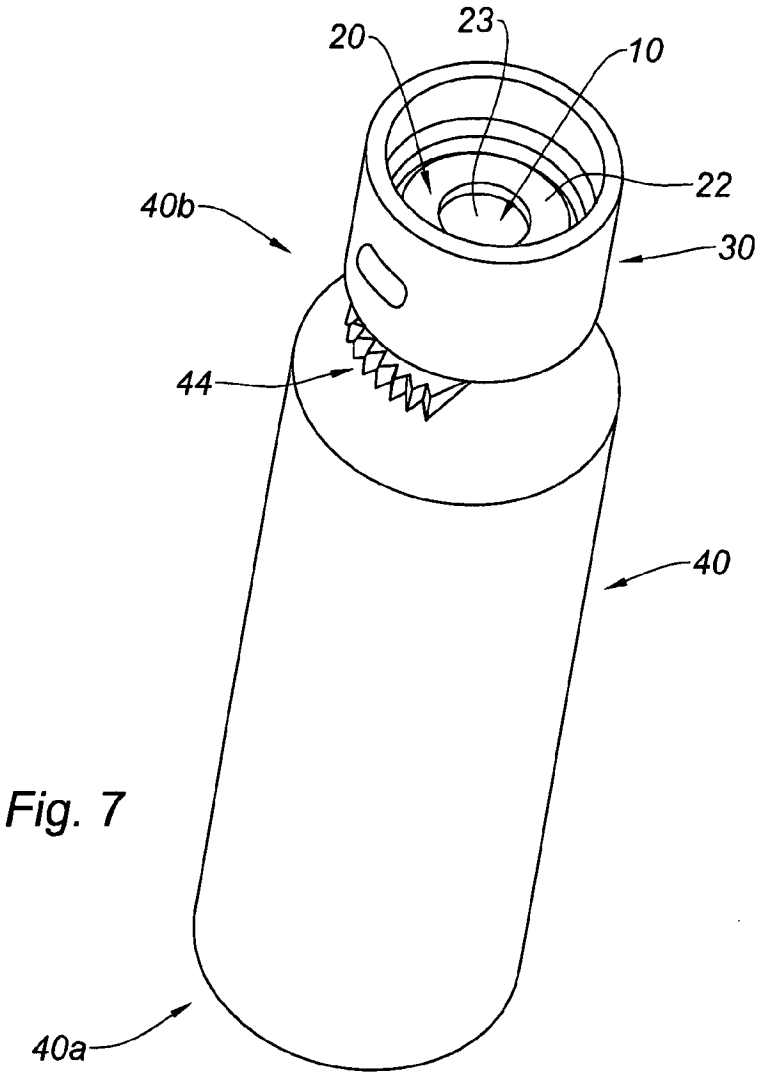
FIG. 7 is a perspective view of the assembly of FIG. 5.

In a first step, the sealing device 1 of FIG. 4 is mounted on the container 40 as shown on FIGS. 5 and 7: the skirt pieces 25 of the cap 20 being outwardly radially deflected, they overcome the collar 41 and its distal outer flange 43 with no problem.

Figure 6:
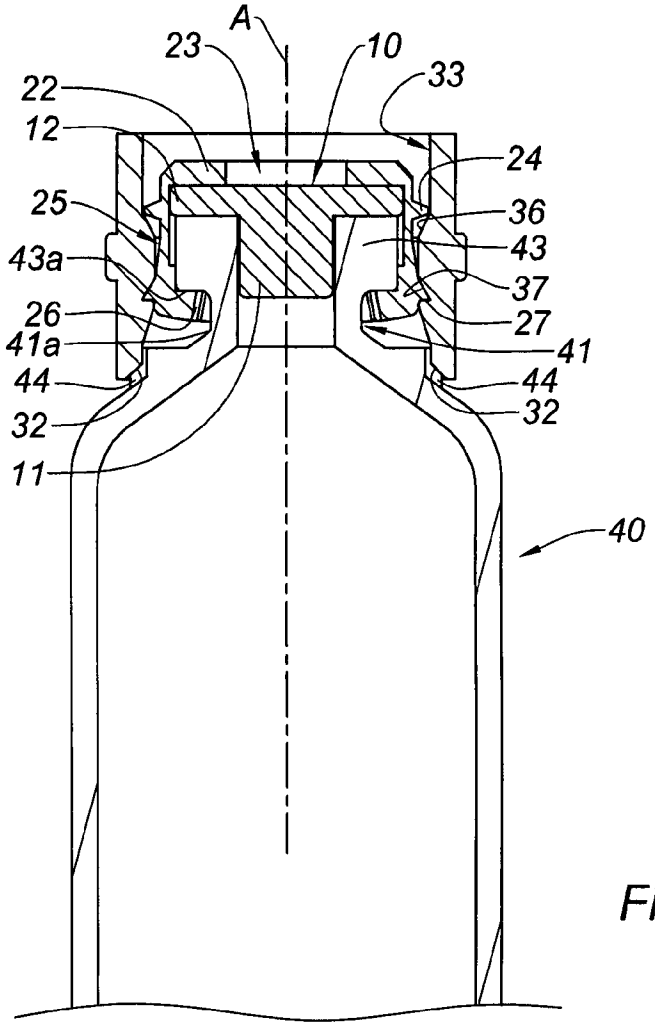
FIG. 6 is a cross section view of the assembly of FIG. 5 once the sleeve is in its proximal position.
Figure 8:
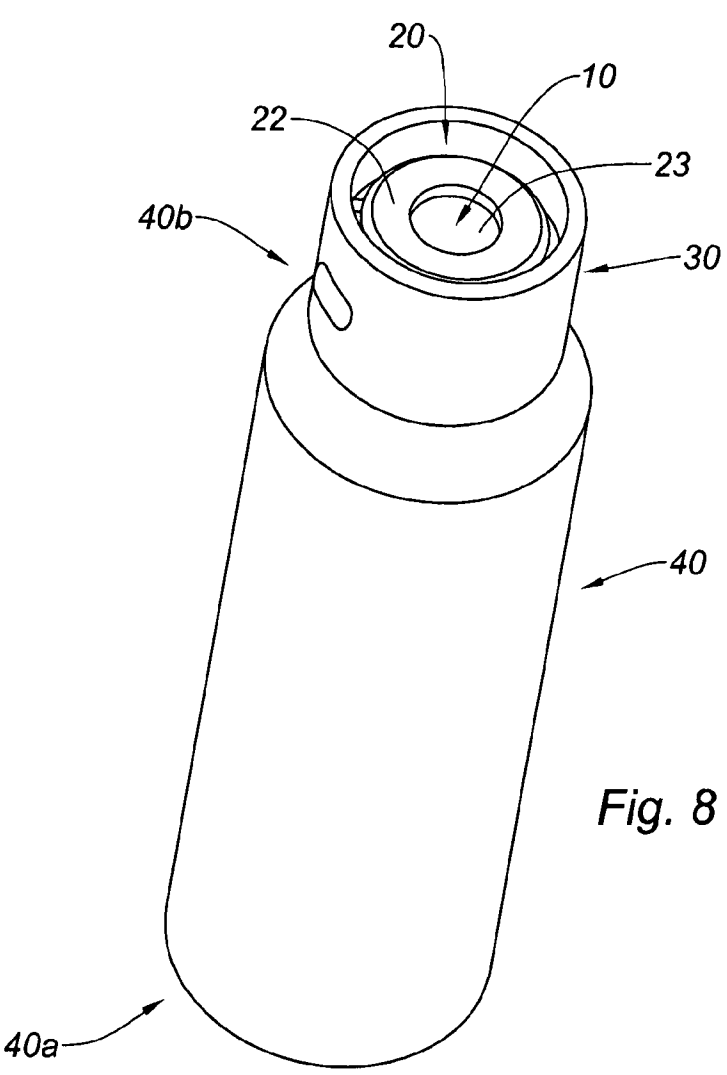
FIG. 8 is a perspective view of the assembly of FIG. 6.

In a second step, a machine applies a proximal force on the distal end of the sleeve 30: this force is sufficient for causing the annular conical groove 37 to overcome the radial projection 24 and for moving the sleeve 30 to its distal position as shown on FIGS. 6 and 8. During this movement, the intermediate portion 35 of the tubular part 31 exerts a radial inward force on the skirt pieces 25 of the cap 20, which deflect inwardly and radially, thereby causing the radial pegs 26 to come in abutment against the proximal face 43*a* of the distal outer flange 43: the cap 20 and the septum 10 are therefore secured axially with respect to the collar 41.

Moreover, as appears from FIG. 6, the plurality of radial teeth 32 cooperate with the radial dots 44 of the container 40: in particular, the space defined between two adjacent radial teeth 32 is dimensioned so as to receive with engagement one radial dot 44. Therefore, the sealing device 1, and in particular the sleeve 30, is blocked in rotation with respect to the collar 41. Moreover, because of the structure of the plurality of radial teeth 32, the dots 44 get engaged in these teeth 32 regardless from the orientation with which the sealing device has been mounted on the container. During this step, the plurality of radial teeth 32 act as guiding means cooperating directly with the radial dots 44 of the container 40, so as to limit the rotation of the sleeve 30 with respect to the container 40 when the sleeve 30 is forced to its proximal position, regardless from the orientation with which the sealing device 1 is mounted on the container 40.

In addition, in the proximal position of the sleeve 30 as shown on FIG. 6, the outer extensions 27 of the free end of the skirt pieces 25 are engaged in the annular conical groove 37 of the inner wall of the tubular part 31 of the sleeve 30. As a consequence, the sealing device 1, and in particular the sleeve 30, is secured axially (in both directions distally and proximally) and rotationally with respect to the collar 41, and by consequence with respect to the container 40.

Moreover, as appears from FIG. 8, in the sealed configuration of the container 40, the septum 10 can still be accessed through the central hole 23. Thus, the container 40 is securely sealed, with no movement between the sleeve 30 and the container 40, and the user can have access to the medicine contained in the container 40 by means of a needle for example capable of piercing the septum 10 so as to reach the medicine contained in the container 40 with no fear that the sleeve 30 be displaced with respect to the container 40 during delivery of the medicine.

The container 40, once prefilled with a medicine, closed at its proximal end 40*a*, for example, with a stopper (not shown), and sealed at its distal end 40*b* with the sealing device of the invention, constitutes a safe storing device for said medicine. Moreover, said prefilled and sealed container 40 is readily usable and may be provided to a user who may readily install it in an infusion pump system without having to complete any previous filling step. Once mounted in an infusion pump system, the stopper may be caused to move in the distal direction so as to expel the medicine through a needle going through the septum 10, thereby delivering the medicine to the patient.

With reference to FIGS. 9-15 is shown another embodiment of the sealing device and assembly of the invention.

Figure 9:
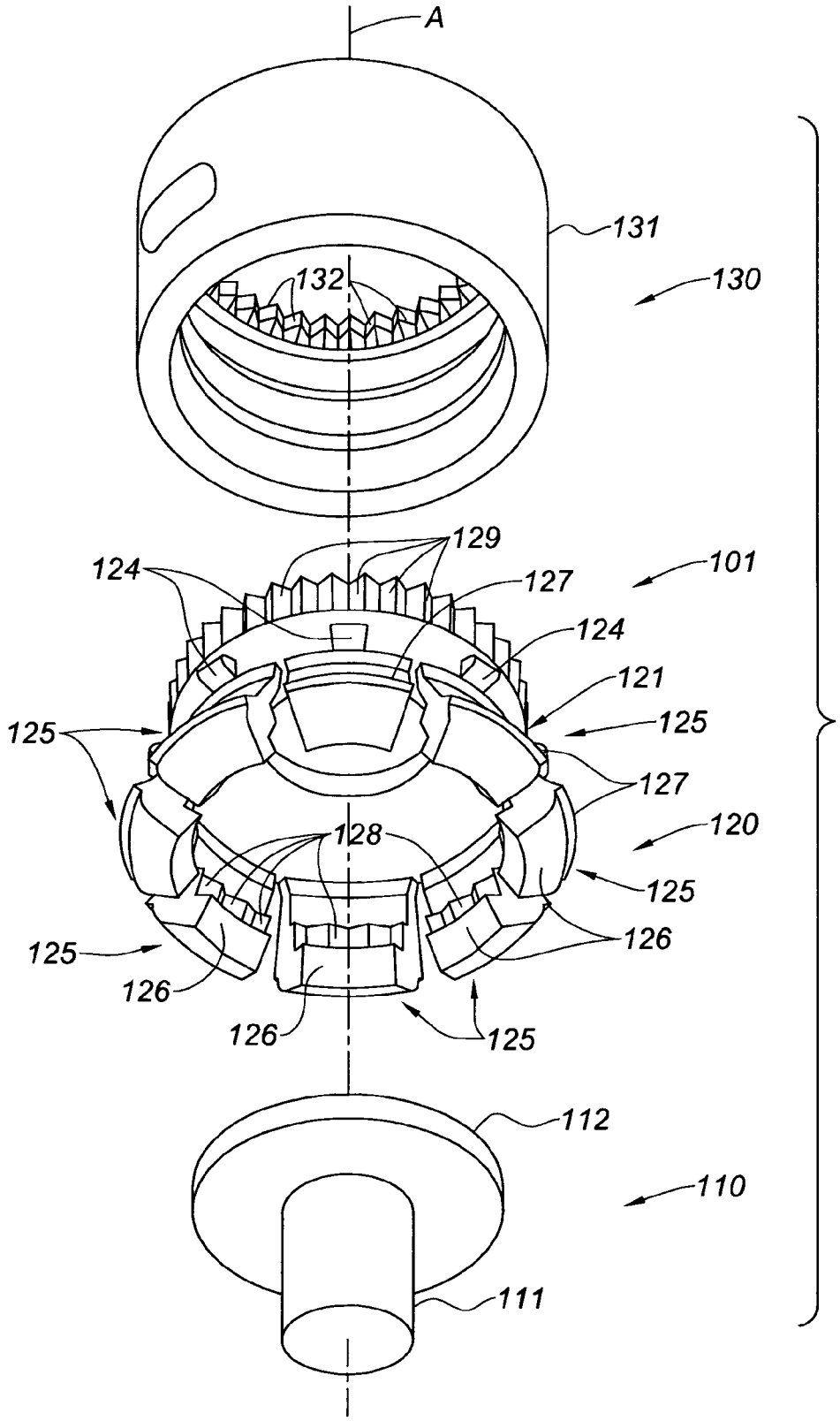
FIG. 9 is an exploded view of another embodiment of the sealing device of the invention.
Figure 10:
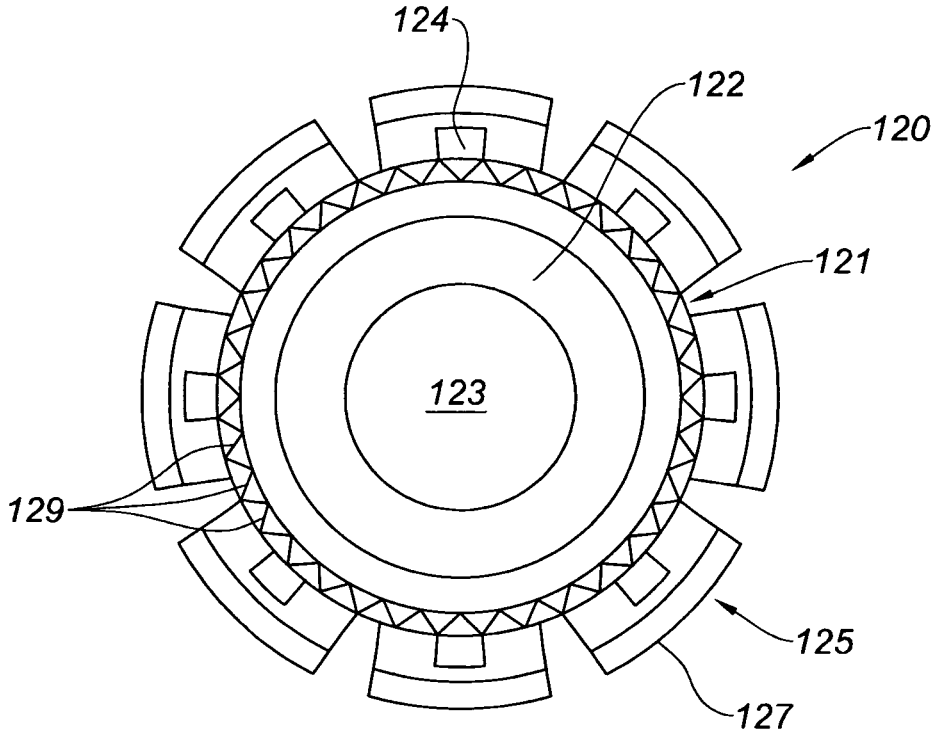
FIG. 10 is a top view of the cap of the sealing device of FIG. 9.
Figure 11:
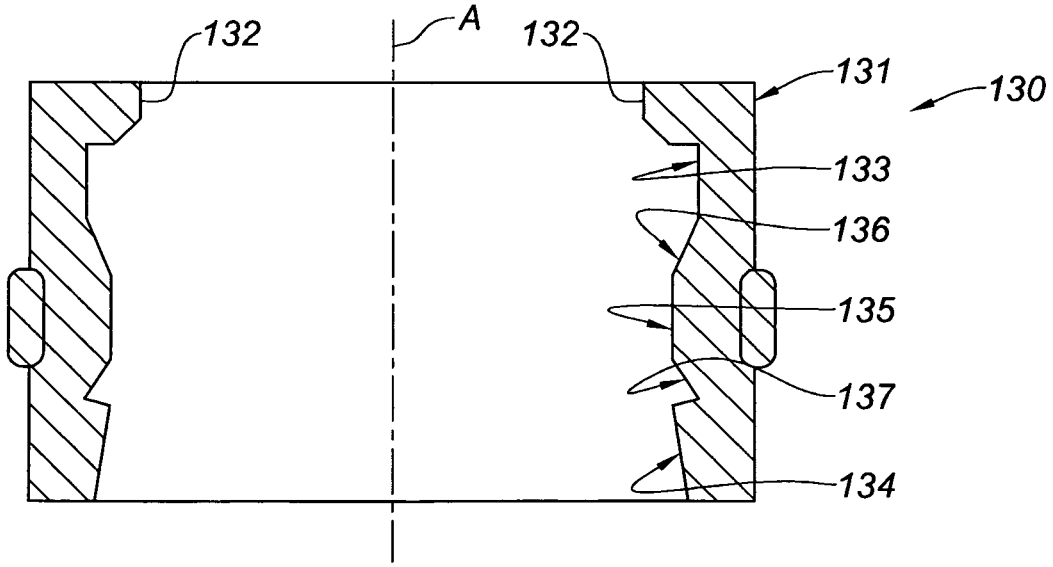
FIG. 11 is a side cross section view of the sleeve of FIG. 9.

With reference to FIGS. 9 to 11, is shown a sealing device 101 of the invention comprising a septum 110, a cap 120 receiving the septum 110, and a sleeve 130 receiving the cap 120: all these pieces are aligned on longitudinal axis A of sealing device 101.

As will appear in the description below, the septum 110 is intended to close the opening of the distal end 40*b* of the container 140 (see FIGS. 12-15) in a tight manner. For instance, the container 140 may be filled with a liquid medicine and the septum 110 is intended to prevent all leaks from the container 140 at its distal end 40*b*. In this view, the septum 110 is designed and shaped so as to be able to close said opening and it is usually made of a rubber material. In the example shown on FIG. 9, the septum 110 comprises a cylindrical part 111 intended to be received within the collar of the container and a transversal wall 112 intended to bear on a flange of the container 140 (see FIGS. 12-15).

The cap 120 is intended to receive the septum 110 and to receive at least part of the collar of the container. In this view, the cap 120 has the global shape of a ring 121 provided in its distal region with an annular transversal wall 122 (see FIG. 10). With reference to FIG. 10, the annular transversal wall 122 defines a central hole 123: as will appear in the description below, this hole 123 provides an access to the septum 110 when the sealing device 101 is mounted on the container it is intended to seal.

The outer wall of the ring 121 is provided with a plurality of radial projections 124, aligned along a circumference of the ring 121 on the example shown, the function of which will be explained later.

The cap 120 is further provided with a plurality, eight on the example shown, of proximal skirt pieces 125, extending from a proximal end of the ring 121. As appears from FIG. 9, these proximal skirt pieces 125 are identical and they substantially occupy the entire circumference of the cap 120. On FIG. 9, these proximal skirt pieces 25 are in a rest position, in which they extend radially outwardly with respect to axis A of the sealing device 101. In addition, each skirt piece 125 is provided on the inner wall of its free end with a radial peg 126, the function of which will be explained later. Each skirt piece 125 is further provided on the outer wall of its free end with an outer extension 127. The inner wall of each skirt piece 125 is further provided, distally spaced with respect to the peg 126, with a plurality of inner radial dots 128, regularly distributed along a circumference of the cap 120 on the example shown.

The distal end of the ring 121 is provided with a plurality of outer radial dots 129 distributed along a circumference of the cap 120.

In embodiments not shown, the number of skirts pieces could be different, such as between 4 and 12 for example.

The sleeve 130 is intended to receive the cap 120: the sleeve 130 has globally the shape of a tubular part 131 designed and shaped so as to be able to receive the cap 120. As appears from FIGS. 9 and 11, the inner wall of the tubular part 131 is provided with a plurality of radial teeth 132, regularly distributed along a circumference of said inner wall on the example shown. On the example shown on FIGS. 9 and 11, the plurality of radial teeth 132 is provided at the distal end of the tubular part 131 forming the sleeve 130.

With reference to FIG. 11, the tubular part 131 is substantially divided along its longitudinal axis A in three portions having different wall thicknesses: a distal portion 133, located just proximally from the plurality of radial teeth 132 and which is a tubular portion, a proximal portion 134 which is substantially conical, and an intermediate portion 135 located between the distal portion 133 and the proximal portion 134 and which is also a tubular portion. The thickness of the intermediate portion 135 is greater than that of the distal portion 133 and the respective inner walls of the distal portion 133 and the intermediate portion 135 are linked to each other by a slanted wall defining an annular conical wall 136. The proximal portion 134 and the intermediate portion 135 are linked to each other by another slanted wall defining an annular conical groove 137 in the inner wall of the tubular part 131. As such, the annular conical groove 137 is proximally spaced from the annular conical wall 136.

As will appear from the description below, the sleeve 130 is movable axially with respect to the cap 120 between a distal position, shown on FIG. 12, in which the said radial projections 124 of the ring 121 of the cap 120 are engaged in the annular conical groove 137 of the sleeve 130 and in which the sleeve 130 does not exert a radial inward force on the skirt pieces 125 of the cap 120, and a proximal position, shown on FIG. 13, in which the outer extensions 127 of the skirt pieces 125 of the cap 120 are engaged in the annular conical groove 137 of the sleeve 130 and in which the sleeve 130 via the wall of its intermediate portion 135 exerts radial inward force on the skirt pieces 125 of the cap 120.

The sealing step of a container with the sealing device 101 of FIGS. 9-11 will now be described with reference to FIGS. 12-14.

Figure 13:
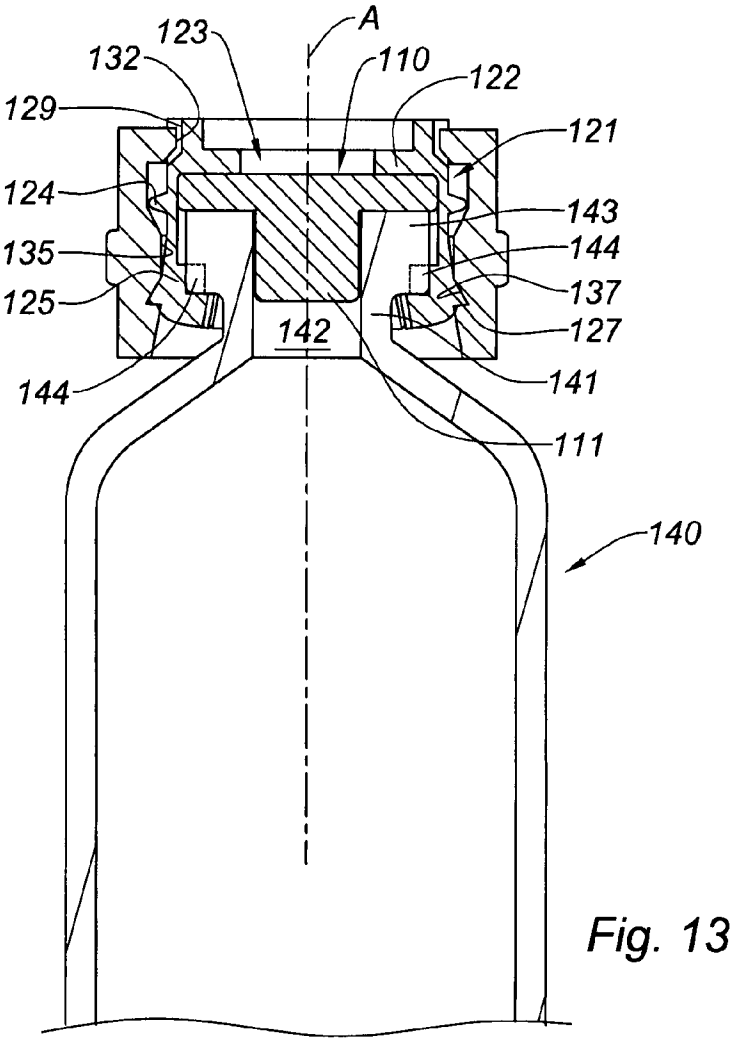
FIG. 13 is a cross section view of the assembly of FIG. 9 once the sleeve is in its proximal position.
Figure 14:
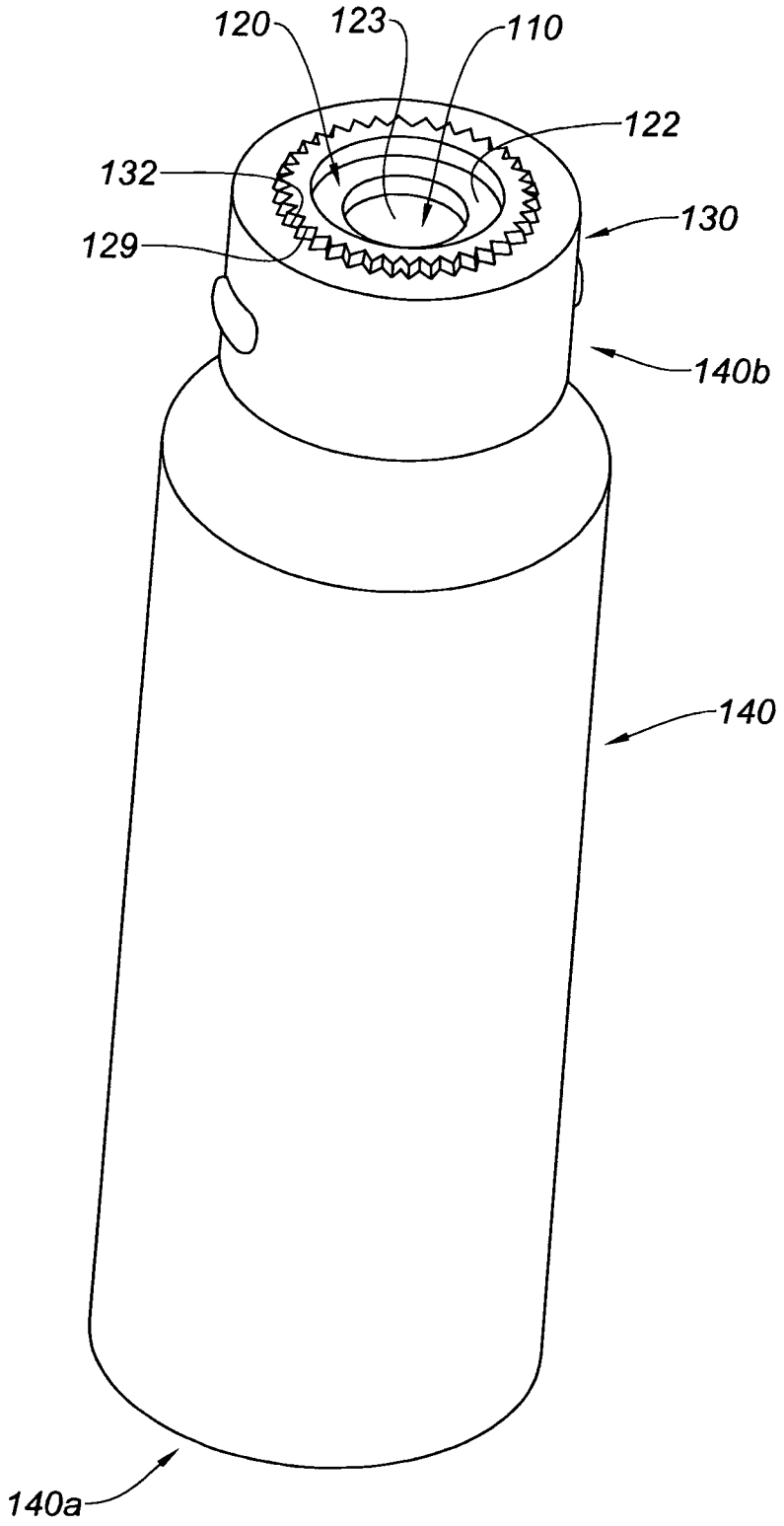
FIG. 14 is a perspective view of the assembly of FIG. 13.
Figure 15:
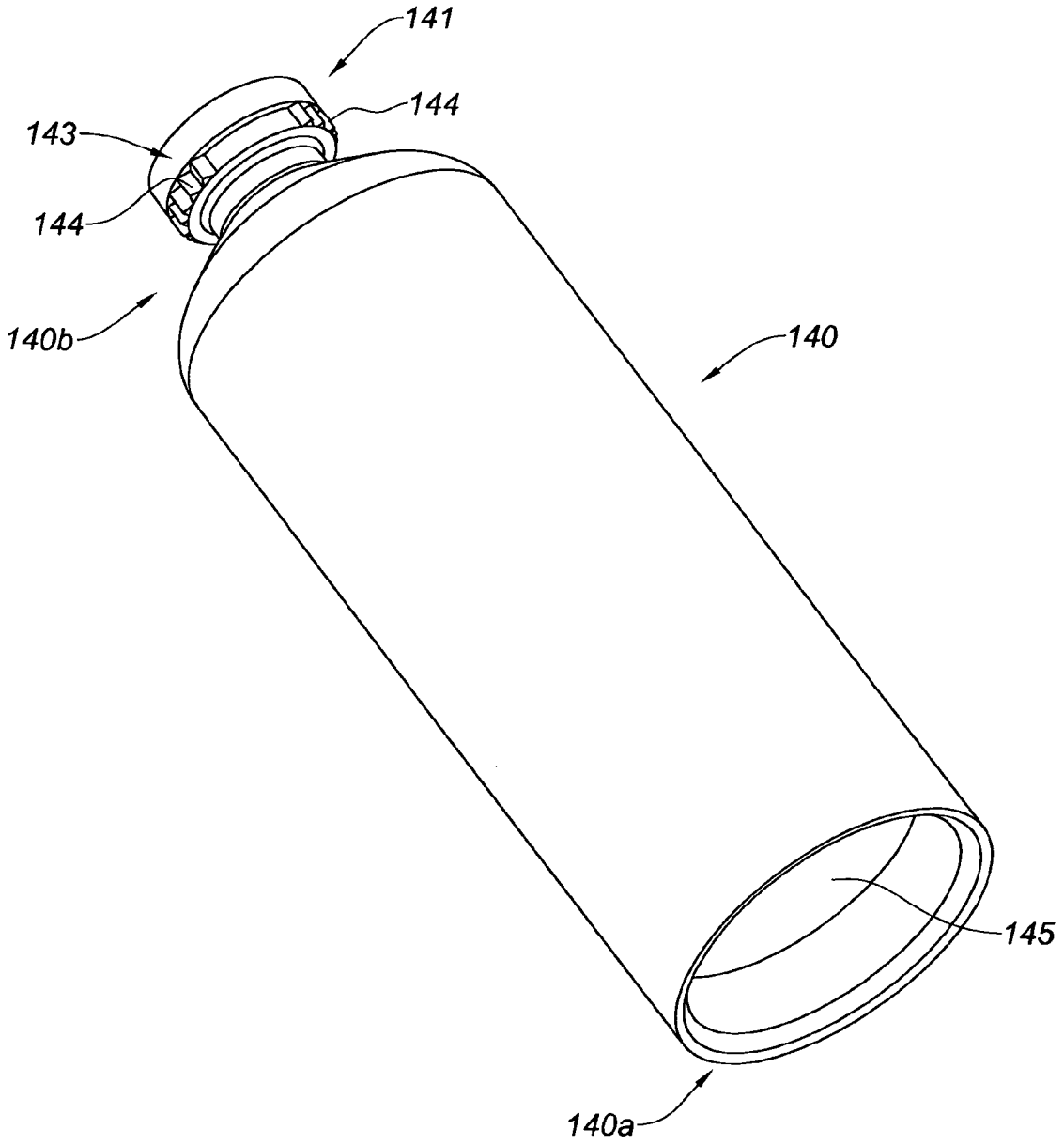
FIG. 15 is a perspective view of the container of FIGS. 12-14.

With reference to FIGS. 12-15, the container 140 to be sealed has a classical tubular shape having a proximal end 140*a* and a distal end 140*b*; with reference to FIG. 15, the proximal end 140*a* is closed by a stopper 145 lodged within the container and in fluid-tight engagement with the inner wall of the container 140. The container 140 may be made of any material adapted for storing and delivering a medicine, such as a liquid medicine for example. For example, the container may be made of glass or plastic material. The container 140 is provided at its distal end 140*b* with a collar 141 defining an opening 142 aligned on a longitudinal axis A. In the example shown, the collar 141 and the container 140 are made of one single piece. Alternatively, the collar 141 could be formed from a different element, however fixed with respect to the container 140. The collar 141 is provided with a distal outer flange 143. With reference to FIG. 15, the collar 141 is further provided on its outer wall with an outer projection under the shape of plurality of radial dots 144: these radial dots 144 are aligned along a circumference of the collar 141, although they do not occupy the entire circumference of the collar 141, as shown on FIG. 15. These radial dots 144 are intended to cooperate with the inner radial dots 128 of the cap 120.

Figure 12:
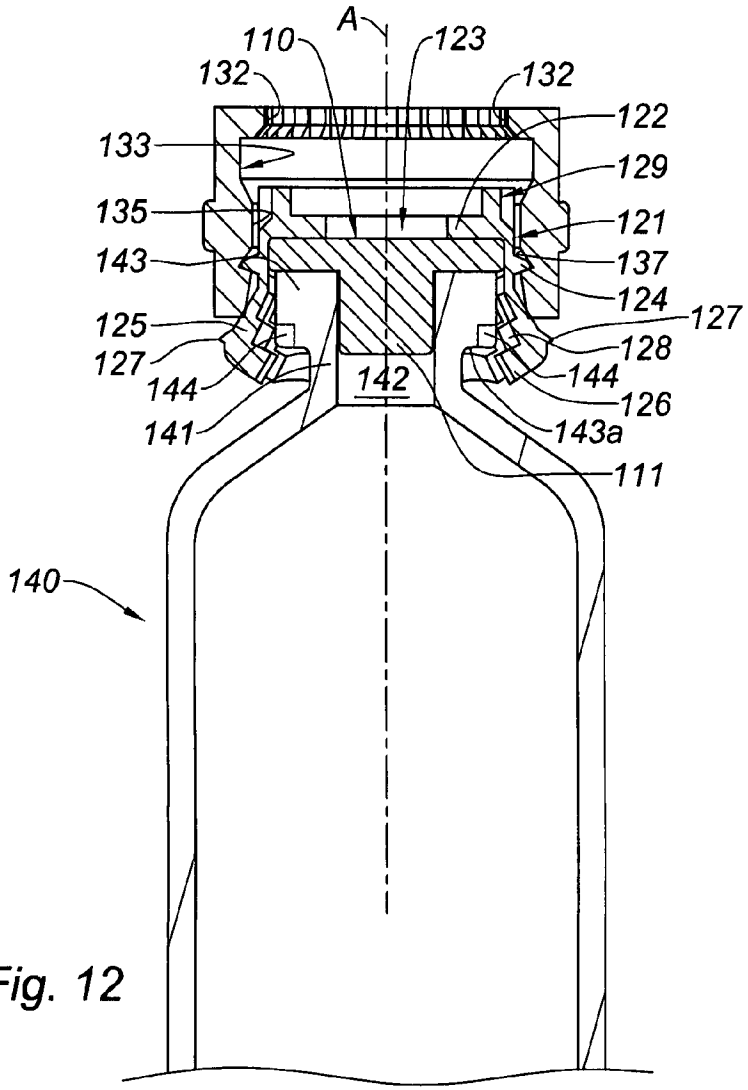
FIG. 12 is a cross section view of the sealing device of FIG. 9 once mounted on a container in the distal position of the sleeve.

The sealing device 101 is provided to proceed with the sealing step in the distal position of the sleeve 130 as shown on FIG. 12. As mentioned before, the sealing step is usually completed by machines at pharmaceutical premises once the container 140 has been filled in with the adequate medicine. The open filled-in container 140 is therefore usually treated on an assembly line. The sealing device 101 is intended to be seized by a machine and put on the top of the container 140 in view of sealing it.

In its position as shown on FIG. 12, the septum 110 is force fitted in the cap 120 with an access to the septum 110 through the central hole 123 of annular transversal wall 122 of cap 120. The sleeve 130 receives the cap 120 and the septum 110 and is in its distal position with respect to the cap 120, with the radial projections 124 of the ring 121 of the cap 120 engaged in the annular conical groove 137 of the sleeve 130. In this position, the sleeve 130 does not exert a radial inward force on the skirt pieces 125 of the cap 120 which are therefore outwardly radially deflected. In such a position of the sleeve 130, the whole sealing device 101, i.e. septum 110, cap 120 and sleeve 130, may be seized by a machine grasping the sleeve 130, since the three pieces of the sealing device 101 are coupled to each other as described above.

In a first step, the sealing device 101 of FIG. 9 is mounted on the container 140 as shown on FIG. 12: the skirt pieces 125 of the cap 120 being outwardly radially deflected, they overcome the collar 141 and its distal outer flange 143 with no problem.

In a second step, a machine applies a proximal force on the distal end of the sleeve 130: this force is sufficient for causing the annular conical groove 137 to overcome the radial projection 124 and for moving the sleeve 130 to its proximal position as shown on FIGS. 13 and 14. During this movement, the intermediate portion 135 of the tubular part 131 exerts a radial inward force on the skirt pieces 125 of the cap 120, which deflect inwardly and radially, thereby causing the radial pegs 126 to come in abutment against the proximal face 143*a* of the distal outer flange 143: the cap 120 and the septum 110 are therefore secured axially with respect to the collar 141.

Moreover, as appears from FIG. 13, the plurality of radial teeth 132 of the sleeve 130 cooperate with the outer radial dots 129 of the cap 120: in particular, the space defined between two adjacent radial teeth 132 is dimensioned so as to receive with engagement one outer radial dot 129. As a consequence, the sleeve 130 is blocked in rotation with respect to the cap 120. In addition, the plurality of inner radial dots 128 of the cap 120 cooperate with the plurality of radial dots 144 located on the outer wall of the collar 141 (see FIG. 15): the radial dots 144 are represented as a dot line on FIGS. 12 and 13. In particular, the space defined by two adjacent inner radial dots 128 is dimensioned so as to receive in engagement one radial dot 144 of the collar 141. As a consequence, the cap 120 is also blocked in rotation with respect to the collar 141, i.e. with respect to the container 140.

The presence of a double set of anti-rotation means, the plurality of radial teeth 132 of the sleeve 130 and the plurality of outer radial dots 129 of the cap 120 on one hand, and the plurality of inner radial dots 128 of the cap and the plurality of radial dots 144 of the collar 141 on the other hand, makes that the sealing device 101, and in particular the sleeve 130, is blocked in rotation with respect to the collar 141. Moreover, because of the structure of the plurality of radial teeth 132, the outer radial dots 129 get engaged in these teeth 132 regardless from the orientation with which the sealing device 101 has been mounted on the container 140. In the same way, because of the structure of the plurality of inner radial dots 128 of the cap 120, the radial dots 144 of the collar 141 get engaged in these inner radial dots 128 regardless from the orientation with which the sealing device 101 has been mounted on the container 140. During this step, the plurality of radial teeth 132 act as guiding means cooperating indirectly, in other words via the cooperation of first the outer radial dots 129 of the cap 120 and of second the inner radial dots 128 with the radial dots 144 of the container 140 which couple the container 140 to the sleeve 130 via the cap 120, so as to limit the rotation of the sleeve 130 with respect to the container 140 when the sleeve 130 is forced to its proximal position, regardless from the orientation with which the sealing device 101 is mounted on the container 140.

In addition, in the proximal position of the sleeve 130 as shown on FIG. 13, the outer extensions 127 of the free end of the skirt pieces 125 are engaged in the annular conical groove 137 of the inner wall of the tubular part 131 of the sleeve 130. As a consequence, the sealing device 101, and in particular the sleeve 130, is secured axially (in both directions distally and proximally) and rotationally with respect to the collar 141, and by consequence with respect to the container 140.

Moreover, as appears from FIG. 14, in the sealed configuration of the container 140, the septum 110 can still be accessed through the central hole 123. Thus, the container 140 is securely sealed, with no movement between the sleeve 130 and the container 140, and the user can have access to the medicine contained in the container 140 by means of a needle for example capable of piercing the septum 110 so as to reach the medicine contained in the container 140, with no fear that the sleeve 130 be displaced with respect to the container 140 during delivery of the medicine.

The container 140, once prefilled with a medicine, closed at its proximal end 140*a* by the stopper 145, and sealed at its distal end 140*b* with the sealing device of the invention, constitutes a safe storing device for said medicine. Moreover, the thus prefilled and sealed container 140 is readily usable and may be provided to a user who may readily install it in an infusion pump system without having to complete any previous filling step. Once mounted in an infusion pump system, the stopper 145 may be caused to move in the distal direction so as to expel the medicine through a needle going through the septum 110, thereby delivering the medicine to the patient.

The invention claimed is:

1. A sealing device for a container having a proximal end and a distal end, said distal end being provided with a collar defining an opening aligned on an axis A and provided with an outer flange, said container being provided on its outer wall with at least one outer projection, the sealing device comprising:

a septum sealingly engageable with said opening when said sealing device is mounted on said container;

a cap receiving said septum and capable of receiving at least part of said collar when said sealing device is mounted on said container, said cap comprising a retainer capable of switching from a first position, in which the retainer does not limit axial movement of said cap with respect to said collar when said sealing device is mounted on said container, to a second position, in which the retainer limits said axial movement under action of a radial inward force exerted thereon; and a sleeve receiving said cap and movable axially with respect to said cap between a distal position, in which said sleeve does not exert a radial inward force on said retainer, and a proximal position, in which said sleeve exerts radial inward force on said retainer, wherein said sleeve comprises a guiding element capable of cooperating directly or indirectly with said at least one outer projection of said container, so as to limit rotation of said sleeve with respect to said container when said sleeve is in the proximal position, regardless from the orientation with which the sealing device is mounted on said container, and wherein the guiding element comprises a plurality of radial teeth, each of said radial teeth having a top portion defined by a pair of angled surfaces that are angled in a radial or latitudinal direction.

2. The sealing device according to claim 1, wherein said plurality of radial teeth are distributed along an inner wall of said sleeve.

3. The sealing device according to claim 2, wherein a space defined between two adjacent radial teeth is dimensioned so as to receive in engagement at least part of said outer projection when said sealing device is mounted on said container and said sleeve is in the proximal position, said guiding element and outer projection therefore cooperating directly with each other so as to limit rotation of said sleeve with respect to said container.

4. The sealing device according to claim 3, wherein said plurality of radial teeth is located at a proximal end of said sleeve.

5. The sealing device according to claim 2, wherein an outer wall of said cap comprises one or more outer radial dots substantially distributed along a circumference of the outer wall of said cap, and an inner wall of said cap comprises a plurality of inner radial dots distributed along a circumference of the inner wall of said cap, wherein the space defined between two adjacent radial teeth is dimensioned so as to be capable of receiving in engagement one outer radial dot when said sleeve is in the proximal position in order to limit the rotation of said sleeve with respect to said cap, and wherein a space defined by two adjacent inner radial dots is dimensioned so as to be capable of receiving in engagement at least part of said outer projection, when said sealing device is mounted on said container and said sleeve is in its proximal position, said guiding element and outer projection therefore cooperating indirectly with each other in order to limit the rotation of said sleeve with respect to said container.

6. The sealing device according to claim 5, wherein said retainer comprises one or more proximal skirt pieces of said cap, each skirt piece being radially flexible and being provided with radial pegs so that, in the first position of the retainer, said radial pegs are not in abutment on a proximal face of said outer flange, and in the second position of said retainer, said radial pegs are in abutment against the proximal face of said outer flange, thereby limiting the axial movement of said cap with respect to said collar.

7. The sealing device according to claim 6, wherein said plurality of inner radial dots is located on inner walls of said skirt pieces.

8. The sealing device according to claim 1, wherein said retainer comprises one or more proximal skirt pieces of said cap, each skirt piece being radially flexible and being provided with radial pegs so that, in the first position of the retainer, said radial pegs are not in abutment on a proximal of said outer flange, and in the second position of said retainer, said radial pegs are in abutment against the proximal face of said outer flange, thereby limiting the axial movement of said cap with respect to said collar.

9. An assembly comprising a container having a proximal end and a distal end, said distal end being provided with a collar defining an opening aligned on an axis A and provided with an outer flange, said container being provided on its outer wall with at least one outer projection, and a sealing device intended to be mounted on said container so as to seal its opening, said sealing device comprising:

a septum sealingly engageable with said opening when said sealing device is mounted on said container;

a cap receiving said septum and capable of receiving at least part of said collar when said sealing device is mounted on said container, said cap comprising a retainer capable of switching from a first position, in which the retainer does not limit the axial movement of said cap with respect to said collar when said sealing device is mounted on said collar, to a second position, in which the retainer limits said axial movement under action of a radial inward force exerted thereon; and a sleeve receiving said cap and movable axially with respect to said cap between a distal position, in which said sleeve does not exert a radial inward force on said retainer, and a proximal position, in which said sleeve exerts radial inward force on said retainer, wherein said sleeve comprises a guiding element capable of cooperating directly or indirectly with said at least one outer projection of said container, so as to limit rotation of said sleeve with respect to said container when said sleeve is in the proximal position, regardless from the orientation with which the sealing device is mounted on said container, and wherein the guiding element comprises a plurality of radial teeth, each of said radial teeth having a top portion defined by a pair of angled surfaces that are angled in a radial or latitudinal direction.

10. The assembly according to claim 9, wherein said plurality of radial teeth are distributed along an inner wall of said sleeve.

11. The assembly according to claim 10, wherein the space defined between two adjacent radial teeth is dimensioned so as to receive in engagement at least part of said outer projection when said sealing device is mounted on said container and said sleeve is in its proximal position, said guiding element and outer projection therefore cooperating directly with each other so as to limit rotation of said sleeve with respect to said container.

12. The assembly according to claim 11, wherein said outer projection being proximally spaced from a distal end of the collar, said plurality of radial teeth is located at a proximal end of said sleeve.

13. The assembly according to claim 10, wherein an outer wall of said cap comprises one or more outer radial dots substantially distributed along a circumference of the outer wall of said cap, and an inner wall of said cap comprises a plurality of inner radial dots distributed along a circumference of the inner wall of said cap, wherein the space defined between two adjacent radial teeth is dimensioned so as to be capable of receiving in engagement one outer radial dot when said sleeve is in the proximal position in order to limit rotation of said sleeve with respect to said cap, and wherein a space defined by two adjacent inner radial dots is dimensioned so as to be capable of receiving in engagement at least part of said projection, when said sealing device is mounted on said container and said sleeve is in the proximal position, said guiding element and outer projection therefore cooperating indirectly with each other in order to limit rotation of said sleeve with respect to said container.

14. The assembly according to claim 13, wherein said retainer comprises one or more proximal skirt pieces of said cap, each skirt piece being radially flexible and being provided with radial pegs so that, in the first position of the retainer, said radial pegs are not in abutment on a proximal face of said distal outer flange, and in the second position of said retainer, said radial pegs are in abutment against the proximal face of said outer flange, thereby limiting the axial movement of said cap with respect to said collar.

15. The assembly according to claim 14, wherein said plurality of inner radial dots is located on inner walls of said skirt pieces, said outer projection being located on the an outer wall of the collar.

16. The assembly according to claim 15, wherein said outer projection is selected from one radial dot and a plurality of radial dots distributed regularly or not along a circumference of the outer wall of the container.

17. The assembly according claim 9, wherein said retainer comprise one or more proximal skirt pieces of said cap, each skirt piece being radially flexible and being provided with radial pegs so that, in the first position of the retainer, said radial pegs are not in abutment on a proximal face of said distal outer flange, and in the second position of said retainer, said radial pegs are in abutment against the proximal face of said outer flange, thereby limiting the axial movement of said cap with respect to said collar.

18. A sealing device for a container having a proximal end and a distal end, said distal end being provided with a collar defining an opening aligned on an axis A and provided with an outer flange, said container being provided on its outer wall with at least one outer projection, the sealing device comprising:

a septum sealingly engageable with said opening when said sealing device is mounted on said container;

a cap receiving said septum and capable of receiving at least part of said collar when said sealing device is mounted on said container, said cap comprising a retainer capable of switching from a first position, in which the retainer does not limit axial movement of said cap with respect to said collar when said sealing device is mounted on said container, to a second position, in which the retainer limits said axial movement under action of a radial inward force exerted thereon; and a sleeve receiving said cap and movable axially with respect to said cap between a distal position, in which said sleeve does not exert a radial inward force on said retainer, and a proximal position, in which said sleeve exerts radial inward force on said retainer, wherein said sleeve comprises a guiding element comprising a plurality of radial teeth distributed along an inner wall of said sleeve, said guiding element capable of cooperating directly or indirectly with said at least one outer projection of said container, so as to limit rotation of said sleeve with respect to said container when said sleeve is in the proximal position, regardless from the orientation with which the sealing device is mounted on said container, wherein an outer wall of said cap comprises one or more outer radial dots substantially distributed along a circumference of the outer wall of said cap, and an inner wall of said cap comprises a plurality of inner radial dots distributed along a circumference of the inner wall of said cap, wherein the space defined between two adjacent radial teeth is dimensioned so as to be capable of receiving in engagement one outer radial dot when said sleeve is in the proximal position in order to limit the rotation of said sleeve with respect to said cap, and wherein a space defined by two adjacent inner radial dots is dimensioned so as to be capable of receiving in engagement at least part of said outer projection, when said sealing device is mounted on said container and said sleeve is in its proximal position, said guiding element and outer projection therefore cooperating indirectly with each other in order to limit the rotation of said sleeve with respect to said container.

* * * * *